US005979320A

United States Patent [19]

Dorenkamp

[11] Patent Number: 5,979,320

[45] Date of Patent: Nov. 9, 1999

[54] INKING UNIT FOR A PRINTING PRESS

[75] Inventor: Felix Dorenkamp, Hemsbach, Germany

[73] Assignee: Heidelberger Druckmaschinen Aktiengesellschaft, Heidelberg, Germany

[21] Appl. No.: 09/165,570

[22] Filed: Oct. 2, 1998

[30] Foreign Application Priority Data

Oct. 2, 1997 [DE] Germany ..... 197 43 769

[51] Int. Cl.[6] ..... B41F 31/14

[52] U.S. Cl. ..... 101/350.3; 101/DIG. 38

[58] Field of Search ..... 101/DIG. 38, 350.3, 101/352.06, 348; 118/259, 258, 261, 262

[56] References Cited

U.S. PATENT DOCUMENTS 3,994,222 11/1976 Pullen ..... 101/DIG. 38
4,620,481 11/1986 Steiner .
5,249,523 10/1993 Kanzler et al. .

FOREIGN PATENT DOCUMENTS

4214210A1 11/1993 Germany .
1145052 3/1969 United Kingdom .

*Primary Examiner*—J. Reed Fisher
*Attorney, Agent, or Firm*—Herbert L. Lerner; Laurence A. Greenberg

[57] ABSTRACT

An inking unit for a printing press, having a plurality of inking rollers for feeding a required ink quantity from an ink fountain to a printing plate, at least one of the inking rollers being additionally capable of performing an axial movement during a press run, includes a drive for driving the inking rollers axially via push rods and rocking levers, the drive including a drive wheel carrying an eccentrically disposed journal pin, and an uncouplable eccentric assigned to and cooperating with the journal pin.

4 Claims, 1 Drawing Sheet

INKING UNIT FOR A PRINTING PRESS

BACKGROUND OF THE INVENTION

Field of the Invention

The invention relates to an inking unit for a printing press, having a plurality of inking rollers for feeding a required ink quantity from an ink fountain to a printing plate, at least one of the inking rollers being additionally capable of performing an axial movement during a press run, and a drive for driving the inking rollers axially via push rods and rocking levers.

The published German Patent Document DE 34 24 721 C2 discloses an inking unit with a drive of the foregoing general type for axially moving inking rollers, and by which a stroke movement is transmissable via a cam disk to a lever which, in turn, transmits the stroke movement to a respective one of the ink rollers via a push rod. The stroke can be set or adjusted between a maximum and a minimum via a ball joint. This conventional drive has a multiplicity of wear locations, so that no uniform axial stroke can be achieved permanently. Roller stopping periods may occur, particularly in the reversal region of the axial movement, which may result in a nonuniform supply of ink to the printing plate.

Proceeding from this state of the prior art, it is accordingly an object of the invention of the instant application to provide an inking unit for a printing press with a drive for driving inking rollers axially, the drive being able to perform a reversible axial stroke movement, largely free of play and with little wear, by relatively simple means.

SUMMARY OF THE INVENTION

With the foregoing and other objects in view, there is provided, in accordance with the invention, an inking unit for a printing press, having a plurality of inking rollers for feeding a required ink quantity from an ink fountain to a printing plate, at least one of the inking rollers being additionally capable of performing an axial movement during a press run, comprising a drive for driving the inking rollers axially via push rods and rocking levers, the drive including a drive wheel carrying an eccentrically disposed journal pin, and an uncouplable eccentric assigned to and cooperating with the journal pin.

In accordance with another feature of the invention, the eccentric is disposed in and is couplable with a reciprocable coupling bushing, at least one of the push rods and rocking levers being articulatingly connected to the coupling bushing.

In accordance with a further feature of the invention, the eccentric is rotatable, and the eccentrically disposed journal pin has an eccentricity at least approximately equal to an eccentricity of the eccentric, so that when the eccentric is uncoupled during rotation thereof, the eccentricity of the journal pin and the eccentricity of the eccentric at least partly cancel one another.

In accordance with a concomitant feature of the invention, the drive includes a disengageable coupling pin provided between the eccentric and the coupling bushing, the eccentric being mounted via roller bearings both on the journal pin and in the coupling bushing.

Thus, in accordance with the invention, a minimum or a maximum stroke is selected by coupling or uncoupling the eccentric. Moreover, rotational movements largely free of play are produced, a permanent and low-wear axial movement being ensured by an appropriate choice of the mountings of the eccentric.

An advantageous embodiment of the invention is provided by arranging the eccentric in a coupling bushing which is movable back and forth and is couplable to the latter, and one or more push rods/pivoting levers are articulatingly connected to the coupling bushing. When the eccentric rotates freely in the coupling bushing in this embodiment, a minimum stroke movement of the inking rollers is achieved. However, when the eccentric is coupled to the coupling bushing, the full eccentricity of the journal pin, and therefore a maximum stroke, are transmitted as axial movement to the inking rollers.

According to a further advantageous embodiment of the invention, the eccentricity of the journal is designed to be equal or approximately equal to the eccentricity of the eccentric, so that, when the rotating eccentric is decoupled, the respective eccentricities of the journal pin and of the eccentric cancel one another completely or partly. By an appropriate design of the eccentricity, the stroke can thus be reduced at most to zero, so that it is possible, in a relatively simple manner, for the pressman to adjust or set two different stroke lengths of the respective inking roller by respectively coupling or uncoupling the eccentric to or from the coupling bushing.

In another advantageous embodiment, a disengageable coupling pin is provided between the eccentric bushing and the coupling bushing, and the eccentric is mounted on the journal pin and in the coupling bushing by means of roller bearings. Coupling and uncoupling via a coupling pin may be performed manually or automatically. Mounting via roller bearings allows operation virtually free of play and free of wear over a very long operating period of the press.

Other features which are considered as characteristic for the invention are set forth in the appended claims.

Although the invention is illustrated and described herein as embodied in an inking unit for a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 3:
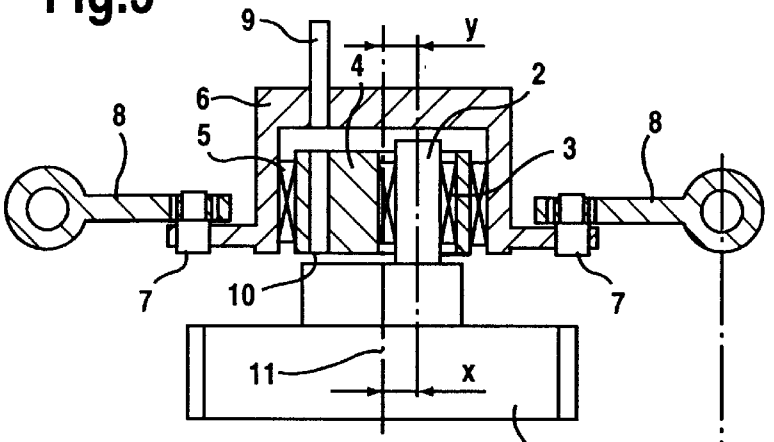
FIG. 3 is a view like those of FIGS. 1 and 2 in a further operating phase of the drive wherein a coupling pin between the eccentric and the coupling bushing is uncoupled.

Referring now to the figures of the drawings, there is shown therein, a drive wheel or gear 1 coupled to a nonillustrated conventional drive of an inking unit and carrying a journal pin 2 which is arranged so as to be offset eccentrically to the middle of the drive wheel 1 by a distance X. Due to the rotational movement of the drive wheel 1, therefore, the journal pin 2 performs a stroke movement over a distance equal to 2×X when the drive wheel 1 has been rotated through 180°.

An eccentric 4 is mounted on the journal pin 2, for example via rolling bearings 3, and, in turn, is arranged in a coupling bushing 6 via a further rolling bearing 5. Instead of rolling bearings, other low-wear mountings ensuring a high degree of freedom from play may also be used. One or more push rods 8 may be fastened pivotally to the coupling bushing 6 via pins 7, so that the push rods 8 can then transmit the back-and-forth or reciprocating movement to the respective inking rollers as an axial movement, for example via rocking levers.

Provided between the eccentric 4 and the coupling bushing 6 is a coupling pin 9 which is engageable in or disengageable from a bore 10 formed in the eccentric 4. A coupling of the two machine parts may also take place via other conventional couplings, and these may be actuated either manually or automatically via a suitable control.

Figure 1:
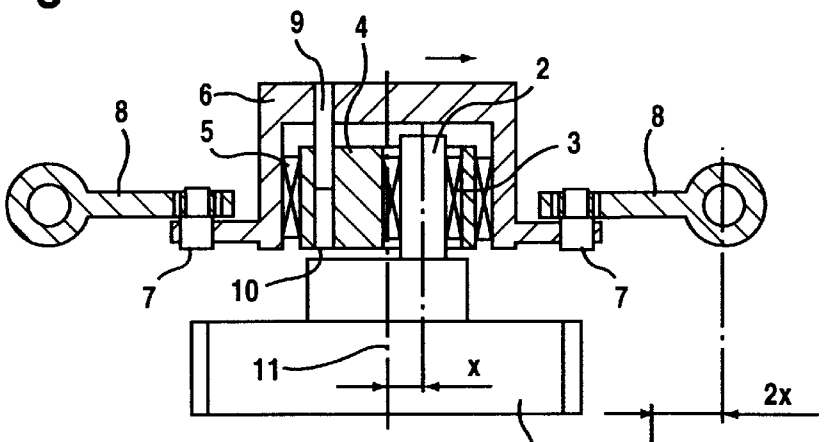
FIG. 1 is a cross-sectional view of a drive according to the invention having a coupling mutually engaging an eccentric and a coupling bushing.
Figure 2:
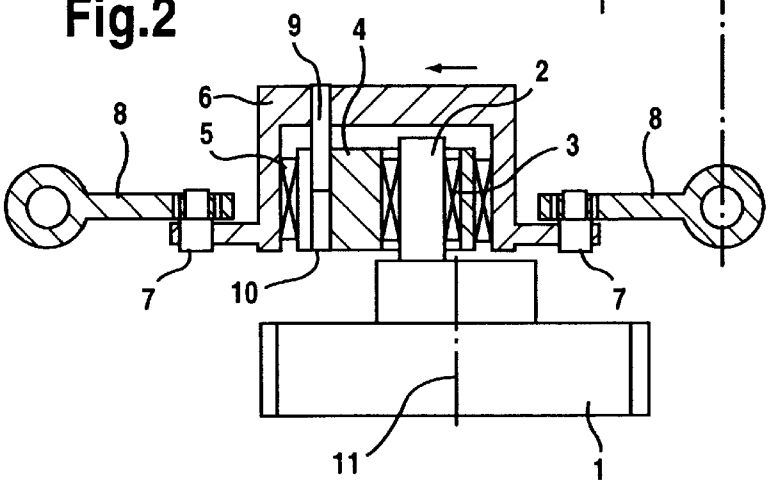
FIG. 2 is a view like that of FIG. 1 in another operating phase of the drive wherein a driving journal is rotated through 180°.

In FIG. 1, the coupling pin 9 is engaged in the bore 10, so that the eccentric 4 is connected fixedly, in terms of rotation, to the coupling bushing 6. In this operating stage or phase, the journal pin 2 is offset towards the righthand side of the figure relative to the central axis 11 of the drive wheel 1 by the distance X. In FIG. 2, the drive wheel 1 has been rotated through 180°, so that the journal pin 2 is offset to the lefthand side of the respective figure likewise by the distance X. The coupling bushing 6 is thereby moved towards the lefthand side of FIG. 2 by the distance 2×X, so that the push rods 8 likewise traverse the distance 2×X which can then be transmitted as a stroke to the respective inking rollers.

Figure 4:
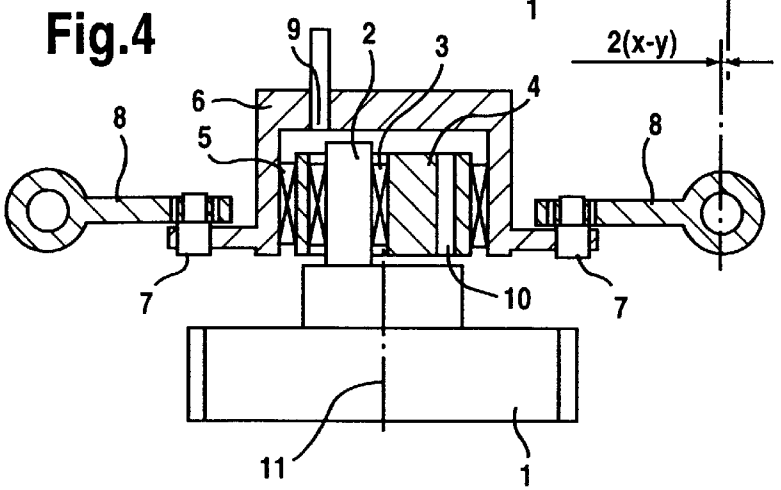
FIG. 4 is a view like that of FIG. 3 in an additional operating phase of the drive wherein the driving journal is rotated through 180°.

In FIG. 3, the journal pin 2 is offset to the righthand side of the respective figure likewise by the distance X as in FIG. 1. In this operating phase, however, the coupling pin 9 is withdrawn from the bore 10, so that the eccentric 4 can rotate freely in the coupling bushing 6. If the eccentricity Y of the bore in the eccentric 4 (in which journal pin 2 is located) relative to the outside diameter of the eccentric 4 is designed to be somewhat smaller than the eccentricity X of the journal pin 2 relative to the central axis 11 of the drive wheel 1, then, in the event of a rotational movement of the drive wheel 1 through 180°, the eccentric 4 is likewise rotated through 180° in the nonrotating coupling bushing 6 (FIG. 4). In this regard, the two eccentricities X and Y largely cancel one another, so that the push rods 8 only traverse a distance of 2(X−Y). If the difference between X and Y were, for example, 0.5 mm, the push rods would reciprocate only 1 mm for a rotational movement of the drive wheel 1 through 180°. This relatively small stroke is transmitted as a corresponding axial movement to the inking rollers.

It is thus possible, in a relatively simple manner, for the pressman to convert the axial stroke of the inking rollers from maximum to minimum by coupling or uncoupling the coupling pin 9.

I claim:

1. An inking unit for a printing press, having a plurality of inking rollers for feeding a required ink quantity from an ink fountain to a printing plate, at least one of the inking rollers being additionally capable of performing an axial movement during a press run, the inking unit comprising:

at least one push rod;

at least one rocking lever;

at least one axial adjustable inking roller;

a drive including a drive wheel having an eccentrically disposed journal pin;

an eccentric mounted on said journal pin for axially driving said at least one inking roller by at least one of said at least one push rod and said at least one rocking lever, a reciprocal coupling bushing, said eccentric disposed in and rotatable within said coupling bushing, a coupling between said eccentric and said coupling bushing; and a disengageable coupler for disengageably connecting said eccentric to said coupling bushing.

2. The inking unit according to claim 1, wherein at least one of said at least one push rod and said at least one rocking lever are pivotably connected to said coupling bushing.

3. The inking unit according to claim 1, wherein said disengageable coupler is a coupling pin having a coupling pin axis, said eccentric has a bore having a bore axis for mounting said eccentric on said journal pin, said drive wheel has a central axis, said eccentric has an eccentric rotation axis, a first distance is defined as a distance between said central axis and said coupling pin axis, a second distance is defined as a distance between said bore axis and said eccentric rotation axis, and said first distance is approximately equal to said second distance so that when said eccentric is uncoupled from said coupling bushing said first distance and said second distance at least partly cancel one another during rotation of said eccentric to inhibit axial driving by said eccentric of said at least one push rod and said at least one rocking lever.

4. The inking unit according to claim 1, further comprising a plurality of roller bearings, wherein said coupling is at least one of said plurality of roller bearings and said eccentric is mounted on said journal pin by at least one of said plurality of roller bearings.

* * * * *